US007857315B2

(12) United States Patent
Hoyt

(10) Patent No.: US 7,857,315 B2
(45) Date of Patent: Dec. 28, 2010

(54) MATHODOMINICS

(76) Inventor: Leon Ray Hoyt, 191 FM-980 South, Point Blank, TX (US) 77364

( * ) Notice: Subject to any disclaimer, the term of this patent is extended or adjusted under 35 U.S.C. 154(b) by 0 days.

(21) Appl. No.: 12/337,543

(22) Filed: Dec. 17, 2008

(65) Prior Publication Data

US 2010/0148443 A1 Jun. 17, 2010

(51) Int. Cl.
*A63F 9/20* (2006.01)

(52) U.S. Cl. ..... 273/293; 273/299; 463/11; 463/12; D21/391

(58) Field of Classification Search ..... 273/293, 273/299; D21/391; 463/11, 12
See application file for complete search history.

(56) References Cited

U.S. PATENT DOCUMENTS

D49,174 S * 6/1916 Burkhardt ..... D21/391
2,748,500 A * 6/1956 Cormack ..... 434/205
4,083,564 A * 4/1978 Matsumoto ..... 273/239
4,125,263 A * 11/1978 Hamilton ..... 273/293
4,257,611 A * 3/1981 Schmitz, Sr. ..... 273/293
5,857,677 A * 1/1999 Sum Chau ..... 273/292
6,062,566 A * 5/2000 Lemons ..... 273/293
6,517,070 B1 * 2/2003 Clapera ..... 273/148 A
6,554,702 B2 * 4/2003 Mahar et al. ..... 463/11
2004/0108657 A1 * 6/2004 Onstad et al. ..... 273/292

* cited by examiner

*Primary Examiner*—Benjamin H Layno
(74) *Attorney, Agent, or Firm*—Delphine James

(57) ABSTRACT

A dominos-style mathematical operation game is provided with a plurality of dominos style type game pieces. Each game piece is defined by a polyhedron with a top and bottom face. Each face is divided into a left and right section with a mathematical operation therebetween.

13 Claims, 4 Drawing Sheets

MATHODOMINICS

BACKGROUND

The present invention relates to dominos style games. More particularly, this present invention relates to a new dominos style game utilizing mathematical operations.

The use of dominos type games are known in the prior art. Additionally, known in the prior art are dominos games based upon mathematical operations. For example, U.S. Pat. No. 6,062,566, dominos-style mathematical operation game discloses a dominos style game using a combination of numbers and the mathematical operation signs. However, the present invention is an uniquely designed dominos game based upon mathematical operations.

SUMMARY

One major objective is to provide a math game that can help individuals practice their mathematical computation skills. The game can be played with simplicity or complexity.

A dominos-style mathematical operation game is provided with a plurality of dominos style type game pieces. Each game piece is defined by a polyhedron with a top and bottom face. Each face is divided into a left and right section with a mathematical operation therebetween.

DESCRIPTION OF PREFERRED EMBODIMENT

Figure 1:
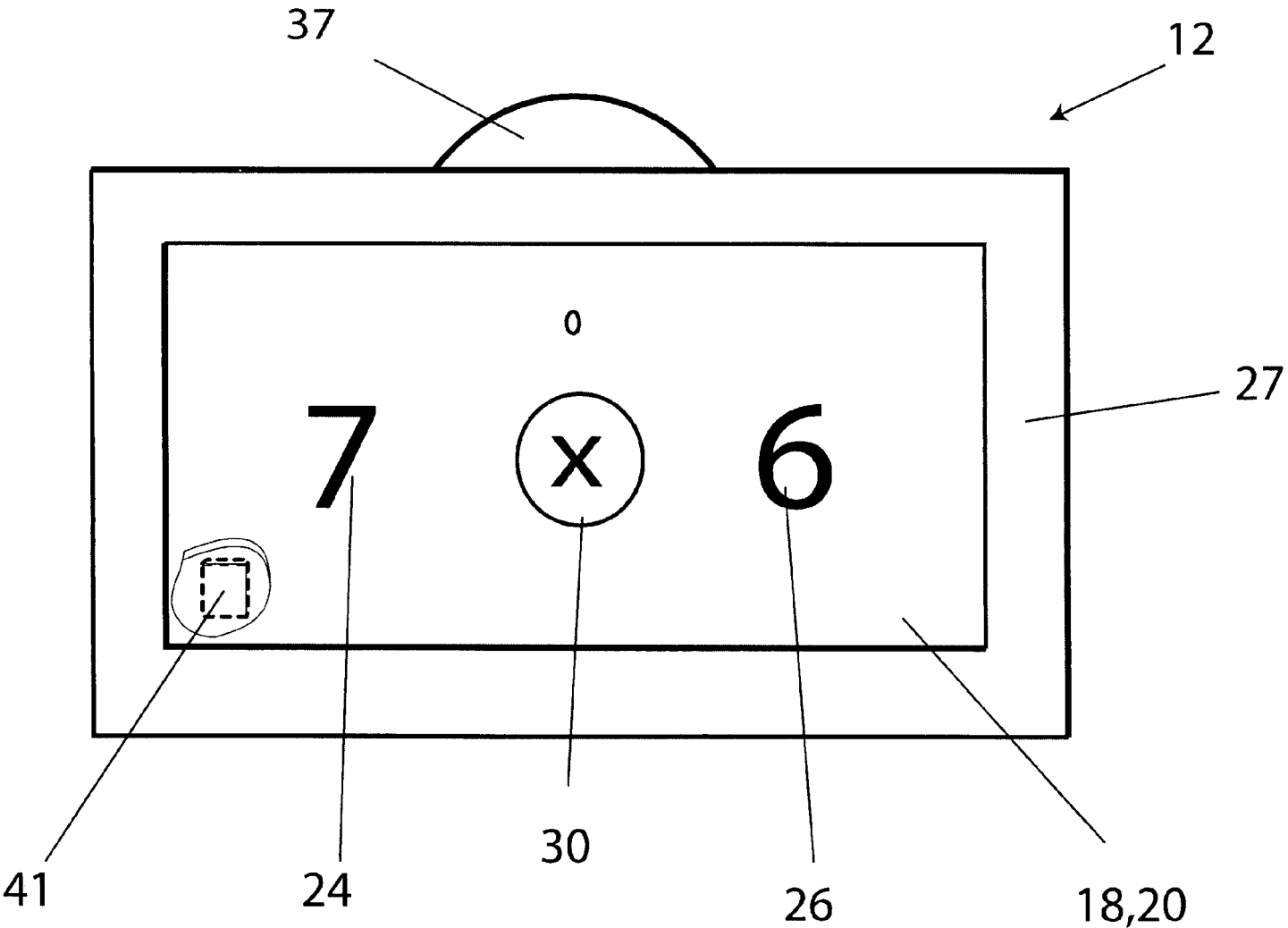
FIG. 1 illustrates a frontal plane view of a new dominos-style mathematical operation game.
Figure 4:
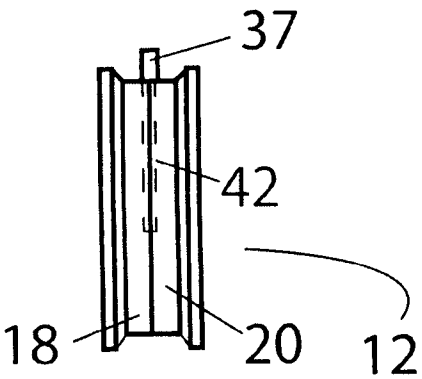
FIG. 4 illustrates a back side view of the dominos-style mathematical operation game.
Figure 2:
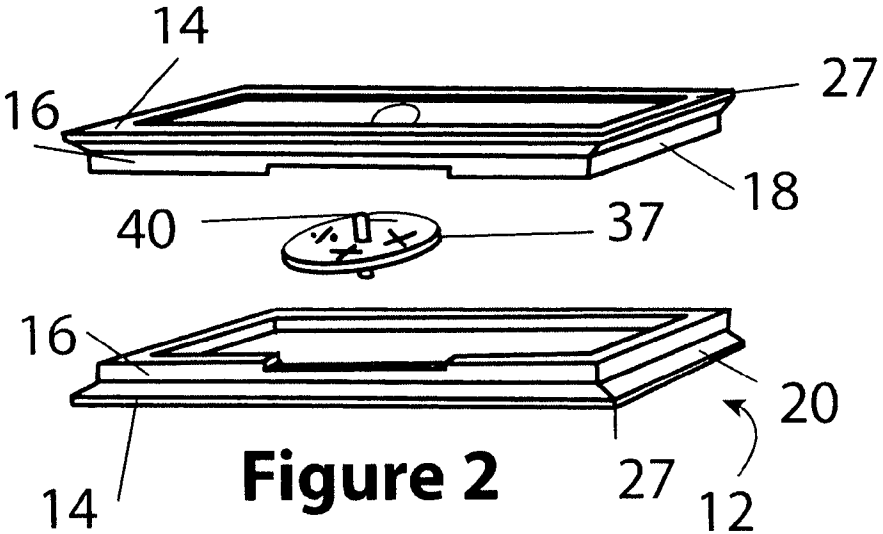
FIG. 2 illustrates an exploded top view of a new dominos-style mathematical operation game.
Figure 3:
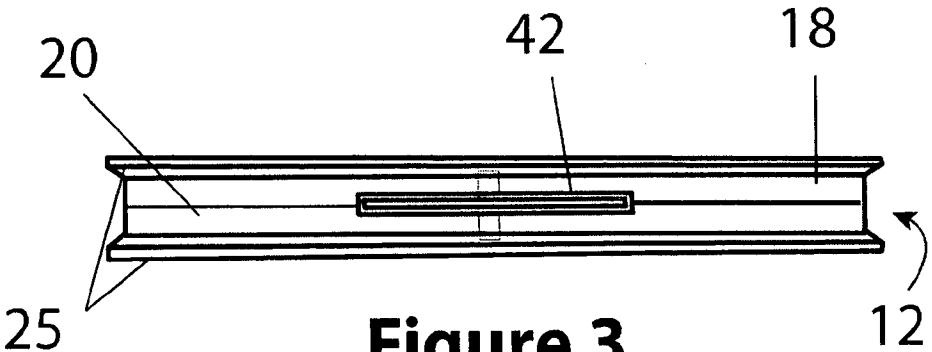
FIG. 3 illustrates a frontal side view of a new dominos-style mathematical operation game.

Referring to FIGS. 1, 2, 3, and 4, the present invention, designated as numeral 12, includes a plurality of dominos cards 12 each having a rectangular polyhedron configuration with a top face (18) and a bottom face (20) with substantially the same dimensions.

Each card 12 is segmented into a top portion 14 and a bottom portion 16 having a top face 18 and a bottom face 20 respectively. The top portion 14 and bottom portion 16 both have a rectangular shape with a top face 18 and a bottom face 20 respectively surrounded by a plurality of sidewalls 25. The peripheral edge 27 along the perimeter of the top face 18 of the top portion is recessed inwardly toward the center of the top face 18. Centrally disposed is a window or opening 30 for viewing the selected mathematical operation showing below. The surrounding sidewalls 25 of the top portion 14 and bottom portion 16 are also recessed inwardly from the perimeter of the top face 18 and inwardly therefrom.

Encompassed between and centrally disposed therein is a means 35 for selecting a specific mathematical operation. In the preferred embodiment, the means for selecting a specific mathematical operation comprises a circular shape disc 37 with a rod 40 centrally disposed therein. Each mathematical operation is incorporated along the circumference of the disc 37. The circular shape disc 37 is enclosed between the top portion 14 and bottom portion 16. A small slot 42 allows the edge of the circular shape disc 37 to be exposed therethrough. In operation, a user rotates the circular shape disc 37 until the desired operation is displayed through the window 30.

As shown the top face 18 and bottom face 20, are divided into a left section 24 and a right section 26 with a movable mathematical operation 30 sign therebetween. Each section (24, 26) incorporates indicia means representing a number therein. Each section (24, 26) has a unique combination of a number with a variable mathematical operation sign therebetween.

The game is played in segments called hands. A hand consists of preferably four players with a hand of 12 cards each. Preferably it is recommended that not more than eight players take part in the game at any one time. The remaining dominos cards (10) comprise the deck which is used by the players to pull extra cards.

The game is designed to be played with all mathematical functions including addition, subtraction, multiplication, and division as shown on mathematical operation means 35. Additionally, the game can be designed to work with algebraic functions wherein the indicia means incorporated on the face of the card can be letters.

Prior to beginning the game a numerical factor should be predetermined and agreed upon by the all the players. This numerical factor is used to determine the raw score of the current player. The game continues until a player reaches a predetermined negative or positive score. At that point the participants choose to either continue the hand until it plays out or end the game.

The game proceeds with selecting the number of domino cards in relations to number of players. Then, proceeding clockwise for the current player's a score is determined for each played card. Then, the raw score is determined by dividing the total score by the predetermined numerical factor thereby calculating the direct score for a particular play.

Each open ended card is computed individually. This individual computation is identified by the used of after each card has been played. The number provided by each producing a total sum of all cards in play as depicted in FIG. 5.

To play a card, it must match the numerical base value of the preceding card regardless of which tentacle alignment it would play against. If the current player has no available playing card, then each current player draws from the deck until a playable card is drawn. The first player to play out all of the game cards and have the highest score is the winner.

The complexity of the game can be varied as the players skills increased. The numbers on each section can be either negative or positive on the mathematical scale.

Figure 5:
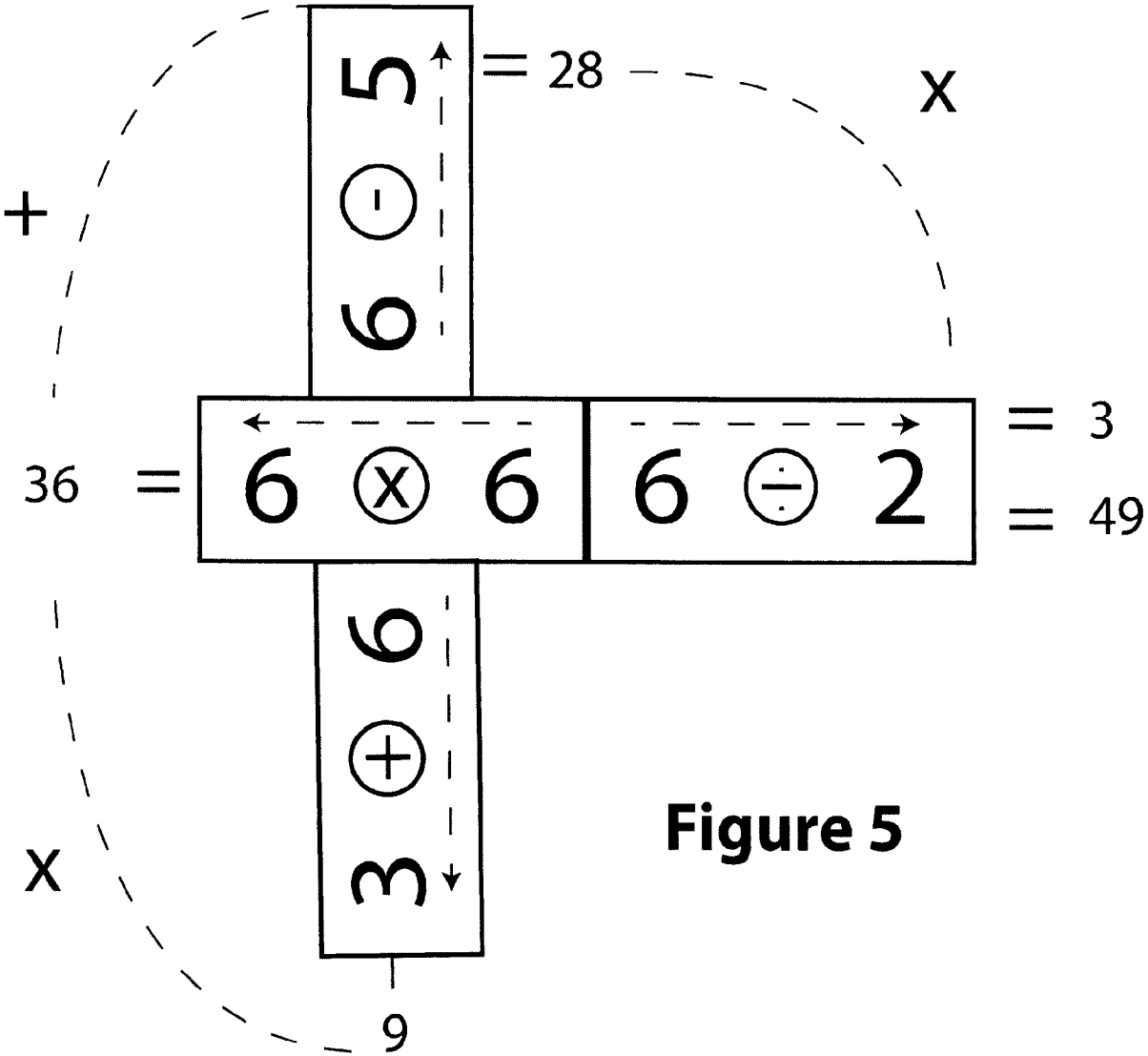
FIG. 5 illustrates a flow chart of a new dominos-style mathematical operation game.
Figure 6:
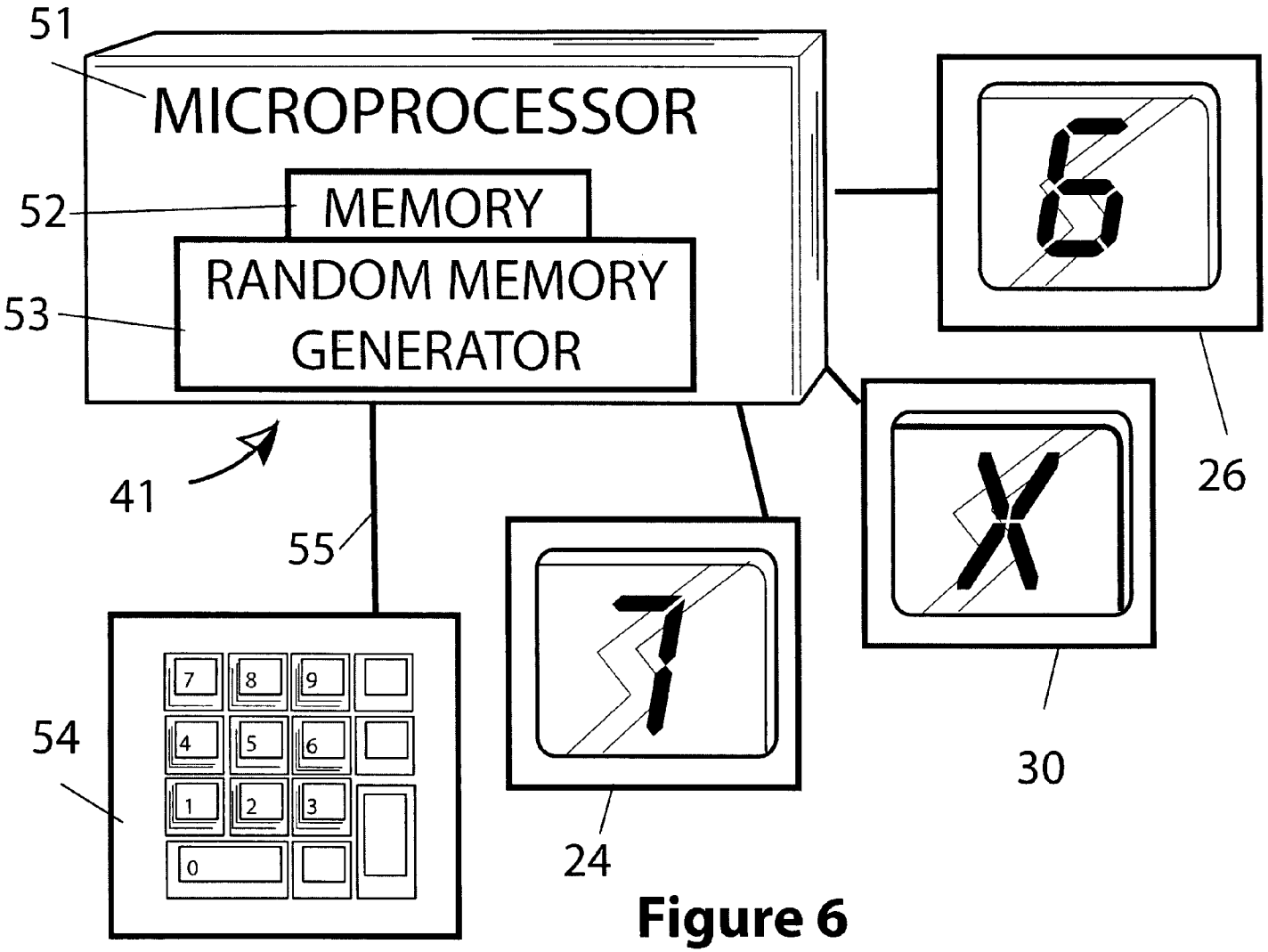
FIG. 6 illustrates an exploded view of the alternative electronic embodiment.

Referring to FIG. 5, there is shown an illustration of how the score is computed in the present invention. In this illustration, the computation proceeds as follows: $(3+6)+(6\times6)+(6-5)+(6/2)$. The total value is "49". The computed value is $(3+36+1+3)/3$ wherein "3" is the predetermined numerical factor. Since "49" does not evenly divide by "3", then there is no direct count computed in this case. Thus, the player does not obtain any points. The game can be adjusted to support fractions by agreement of the players.

In alternative embodiments, each card can be constructed to accommodate an electronic chips or chips. The electronic chips are programmed to select and digitally display upon each domino indicia means to support the mathematical game. In this embodiment as shown in FIG. 1, each domino can be incorporated with an electronic means (41) for controlling selection and display of an indicia means upon a first display means, a second display means and an operational display means. In this embodiment, the upper portion and lower portion have a face divided into a left section (24) and a right section (26) with an operational window (30) therebeteween. The first display means is incorporated upon the left section (24) for displaying a first indicia means. As illustrated number 7, would be displayed upon left section (24). The second display means is incorporated upon the right section (26) for displaying a second indicia means. As illustrated number 6, would be displayed upon right section (26). The operational display means is incorporated upon the operational window (30) for displaying a mathematical operation. As illustrated number "X", would be displayed upon operational window (30). Each display means mentioned above can be a LED, LCD, Liquid Plasma or another suitable display means Thus, as illustrated the number 7, number 6, and "X" would be displayed utilizing LED's or LCD. The electronic means (41) can be a semi-conductor chip or chips having a processor (51), memory (52), and Input/output capability (55). The electronic means (41) can automatically control the display of the indicia means or provide the user an option to select the indicia means or mathematical operation to display through standard input means. The indicia means can be numerical or alphabetic for algebraic operations. The display means can be raised or in Braille to support blind persons. The input means can be keyboard like, handwritten recognition or voice recognition. The input means can be implemented through a small keyboard upon peripheral edge 27. Alternatively, an input communication port can be added into peripheral edge 27 near electronic means 41 and a removable keyboard can be connected to domino card 12. The electronic means comprises a random number generator software (53) that programs the processor to randomly compute a left indicia means. a right indicia means, and a mathematical operation.

What is claimed is:

1. An interchangeable mathematical dominos game device comprising:

a plurality of dominos game pieces with each dominos having a rectangular polyhedron shape;

each dominos being segmented into an upper portion and a lower portion of equivalent dimensions, size and shape;

the upper portion overlaying and being attached to the lower portion;

a mechanical means for selecting a mathematical operation internally disposed between the upper portion and the lower portion wherein a user can vary the mathematical operation;

the upper portion and the lower portion being surrounded by a plurality of side walls;

the upper portion and lower portion having a face divided into a left section and a right section with a window between the left section and the right section, the window for viewing a mathematical operation selected by a user with the mechanical means for selecting the mathematical operation;

the left section and the right section each having a numerical indicia means incorporated thereupon wherein the user selects a corresponding mathematical operation using the mechanical means for operation upon the numerical indicia means; and the corresponding mathematical operation consisting of a physical representation of addition, subtraction, division, multiplication, equality, calculus operations, comparison, and algebraic equations wherein the numerical indicia on the left section, the mathematical operation and the numerical indicia on the right section in combination formulates a new device for computing a mathematical equation by a user.

2. The mathematical dominos game device of claim 1 wherein the face of the upper portion having a perimeter being recessed and tapered inwardly towards a center.

3. The mathematical dominos game device of claim 1 wherein the face of the lower portion having a perimeter being recessed and tapered inwardly towards a center.

4. The mathematical dominos game device of claim 1 wherein the plurality of side walls of the upper portion being recessed and tapered inwardly.

5. The mathematical dominos game device of claim 1 wherein the plurality of side walls of the lower portion being recessed and tapered inwardly.

6. The mathematical dominos game device of claim 1 wherein the indicia means is raised to allow a player to feel the incorporated number therein.

7. The mathematical dominos game device of claim 1 wherein the indicia means is engraved therein to allow a player to feel the incorporated number.

8. The mathematical dominos game device of claim 1 wherein the indicia means is incorporated in Braille to support a blind person.

9. The mathematical dominos game device of claim 1 wherein the indicia means is a letter to support algebraic operations.

10. The mathematical dominos game device of claim 1 wherein the indicia means are numerical.

11. The mathematical dominos game device of claim 1 wherein the means for selecting further comprises:

a disc having a pin extending centrally therethrough; and a plurality of mathematical operations indicia incorporated peripherally along the circumference of the disc.

12. A method of playing a mathematical dominos game comprising the steps of:

providing a plurality of rectangular polyhedron shape dominos cards, each domino card having a top face and a bottom face, each face being divided into a left side having a numerical indicia means and a right side having a numerical indicia means with a mathematical operation within a window situated between the left side and the right side, a mechanical means for selecting a mathematical operation by a player for viewing within the window, prior to beginning the mathematical dominos game, selecting a random predetermined numerical factor by players of the game;

providing each player with a corresponding hand of a predetermined subset of the dominos cards with a remaining portion of the dominos cards comprising a deck of non-active domino cards;

for the current player, selecting a domino card from its hand to become an active card within an active deck of domino cards defined by a plurality of adjacently aligned cards based upon a corresponding adjacent numerical base;

aligning the selected domino card with a numerical base of an exposed side of a domino card within the active deck;

if the current player have no matching active card within its hand, then allowing the current player to pull a card from the deck of non-active cards until a domino card is pulled that matches the numerical base of an exposed side within the active deck;

simultaneously, the player selecting a mathematical operation on the domino card using the mechanical means for selecting a mathematical operation that formulates a mathematical equation using the numerical indicia means on the left side, the numerical indicia means on the right side and the selected mathematical operation that provides the current player with the most points based upon the exposed side of the domino card;

determining the current player total points by summing clock wise each of the most points on the exposed side of each domino card of the active deck;

determining the current player total points by dividing the total points by the numerical factor.

13. A mathematical dominos game comprising:

a plurality of dominos game pieces with each dominos having a rectangular polyhedron shape;

each dominos being segmented into an upper portion and a lower portion of equivalent dimensions, size and shape;

the upper portion overlaying and being attached to the lower portion;

an electronic means internally disposed between the upper portion and the lower portion for controlling selection and display of an indicia means upon a first display means, a second display means and an operational display means;

the upper portion and the lower portion being surrounded by a plurality of side walls;

the upper portion and lower portion having a face divided into a left section and a right section with an operational window between the left section and the right section, the first display means incorporated upon the left section for displaying a first numerical indicia means;

the second display means incorporated upon the right section for displaying a second numerical indicia means; and the operational display means incorporated upon the operational window for displaying a mathematical operation;

and a processor programmed to randomly compute a left numerical indicia means, a right numerical indicia means, and a mathematical operation to respectively display on the first display means, second display means, and the operational display means.

* * * * *

UNITED STATES PATENT AND TRADEMARK OFFICE

CERTIFICATE OF CORRECTION

PATENT NO. : 7,857,315 B2
APPLICATION NO. : 12/337543
DATED : December 28, 2010
INVENTOR(S) : Leon Hoyt It is certified that error appears in the above-identified patent and that said Letters Patent is hereby corrected as shown below:

On the Title Page Item (54) & Col. 1 Line 1 the title of the invention needs to be corrected to MathoDomics Signed and Sealed this
Thirteenth Day of December, 2011

David J. Kappos

David J. Kappos
*Director of the United States Patent and Trademark Office*